United States Patent [19]

Anderson

[11] Patent Number: 4,828,428

[45] Date of Patent: May 9, 1989

[54] DOUBLE TAMPING BAR VIBRATORY SCREED

[75] Inventor: Morell Anderson, East Moline, Ill.

[73] Assignee: Pav-Saver Manufacturing Company, East Moline, Ill.

[21] Appl. No.: 111,805

[22] Filed: Oct. 23, 1987

[51] Int. Cl.[4] ..... E01C 19/34

[52] U.S. Cl. ..... 404/102; 404/105; 404/133

[58] Field of Search ..... 404/75, 101, 102, 105, 404/133, 116; 425/456

[56] References Cited

U.S. PATENT DOCUMENTS

| | | | |
|---|---|---|---|
| 1,306,353 | 6/1919 | Reynolds | 404/102 |
| 1,495,901 | 5/1924 | French | 404/133 |
| 1,887,341 | 11/1932 | Venable | 404/75 |
| 1,898,158 | 2/1933 | Winkler | 404/102 |
| 1,953,825 | 4/1934 | Finley et al. | 404/75 |
| 2,030,315 | 2/1936 | Noble | 404/102 |
| 2,098,895 | 11/1937 | Velten | 404/133 |
| 2,168,507 | 8/1939 | Barber | 404/114 |
| 2,245,426 | 6/1941 | Baker | 404/102 |
| 2,346,379 | 4/1944 | Jackson | 404/102 X |
| 2,633,782 | 4/1953 | Clement | 404/133 |
| 3,075,436 | 1/1963 | McRae | 404/133 |
| 3,147,678 | 9/1964 | Lewis | 404/102 |
| 3,614,916 | 10/1971 | Benson | 404/133 |
| 3,817,644 | 6/1974 | Matson | 404/114 |
| 4,127,351 | 11/1978 | Vural | 404/72 |
| 4,493,585 | 1/1985 | Axer | 404/102 |
| 4,507,014 | 3/1985 | Heims et al. | 404/102 |

*Primary Examiner*—Jerome W. Massie
*Assistant Examiner*—Matthew Smith
*Attorney, Agent, or Firm*—Silverman, Cass, Singer & Winburn, Ltd.

[57] ABSTRACT

A double tamping bar vibratory screed is disclosed for use with a lay-down machine for laying a roadway. The screed consists of a main body portion having a strike-off plate on its leading edge which is followed by two tamping bars having independent eccentric shafts. These tamping bars are in turn followed by a vibrating plate which together perform the necessary compaction and provide a smooth, even surface with a variety of materials.

The tamping bars are resiliently designed with a slightly rearward angle of attack and have horizontal material engagement faces which contact the material to be compacted and provide the desired result.

12 Claims, 5 Drawing Sheets

DOUBLE TAMPING BAR VIBRATORY SCREED

BACKGROUND OF THE INVENTION

1. Field of the Invention

The present invention is directed to highway finishing machines and, more particularly, to a double tamping bar vibratory screed for laying a roadway which is capable of being affixed to a conventional piece of lay-down equipment and can run at higher speeds while providing an extremely high compaction density, especially with high density materials.

2. Description of the Related Art

Highway finishing machines are well known in the art and generally consist of a lay-down machine which accepts the material that is to form the roadbed, distributes it across the desired width of roadway to be laid and compacts the material, usually with a vibrating plate, to a desired compaction rate and finish. These machines have been found to be effective for laying some materials, such as asphalt, as well as some types of conventional concrete.

Recently, highway construction companies have found it very desirable to lay road mixes having higher densities in order to reduce wear on the roadways and thereby increase their life and to accommodate traffic of heavy vehicles and equipment. These higher densities are normally provided in concrete applications by increasing the level of aggregate within the concrete mix itself. One form of high density concrete is known as roller-compacted concrete which is known as a zero-slump concrete mixture and which has been basically used for low-volume, low speed roadways having vehicle traffic with high axial loads.

Due to its increased density, roller-compacted concrete has been very difficult to lay with conventional road paving machinery. This is due to its lack of plasticity which prevents it from flowing into a smooth even surface and inhibits proper compacting. A smooth finish is necessary for roadways, especially where a higher vehicle speed is desired, in order to prevent excess tire wear and reduce noise. Proper compacting is necessary in order to prevent breakdown of the roadway, especially when heavy equipment and vehicles are used.

Roadway laying machines have been developed for laying this type of high density or roller-compacted concrete. One type of such a machine is disclosed in U.S. Pat. No. 4,507,014 issued to Heims et al which discloses a highway finishing machine having at least two stamps which have a common eccentric support. These two stamps cooperatively slidingly engage with one another and have different vertical lengths so that they reciprocate at two slightly different levels.

Major disadvantages with existing highway paving machines, especially when used for laying high density materials such as roller-compacted concrete, are their relatively slow linear speeds, their inability to adapt to different materials and consistencies and their tendency to break up or tear the material being applied. Therefore, the process becomes very time consuming and creates the need for further compacting and surface treatment after the initial layer is applied.

SUMMARY OF THE PRESENT INVENTION

The present invention provides a method and apparatus for laying a variety of materials to form a road surface or, alternatively, a base material for a road surface which can be adjusted to include asphalt and conventional concrete as well as roller-compacted concrete. Additionally, the apparatus of the present invention is capable of operating at much higher speeds while providing a very smooth, even surface and an extremely high compaction rate.

The present invention is embodied in a highway finishing machine having a main body portion which is detachably mounted to a conventional concrete or asphalt lay-down machine. The front end of the main body portion is positioned adjacent the rear end of the lay-down machine and has a strike-off plate on its leading edge which strikes off the material provided by the lay-down machine at a predetermined vertical height in preparation for compacting. Located a predetermined distance behind the strike-off plate are two tamping bars having independent eccentric shafts which are positioned parallel to one another and span the width of the machine. Furthermore, these tamping bars are resiliently attached to the eccentric shafts to help deter complete breakdown or over-compaction of the material.

These tamping bars are particularly significant since they are designed with a slightly rearward angle of attack and have horizontal material engagement faces which contact the material to be compacted. This design forces the material straight down and toward the rear of the device instead of toward the strike-off plate which allows a wider variety of applications without tearing the surface of the material.

Located immediately behind the tamping bars is a vibrating plate which aids compaction and improves the surface texture when laying particular types of material.

The advantages of such a device are its compact form, its ability to adapt to a wide range of existing lay-down equipment, its ability to operate at higher speeds and its ability to handle a wide variety of materials including very dense materials such as roller-compacted concrete.

BRIEF DESCRIPTION OF THE DRAWINGS

Further features and advantages of the present invention are set forth with particularity in the appended claims. The invention may best be understood by making reference to the following description, taken in conjunction with the accompanying drawings and several figures of which like reference numerals identify identical elements and wherein:

DESCRIPTION OF THE PREFERRED EMBODIMENTS

Figure 1:
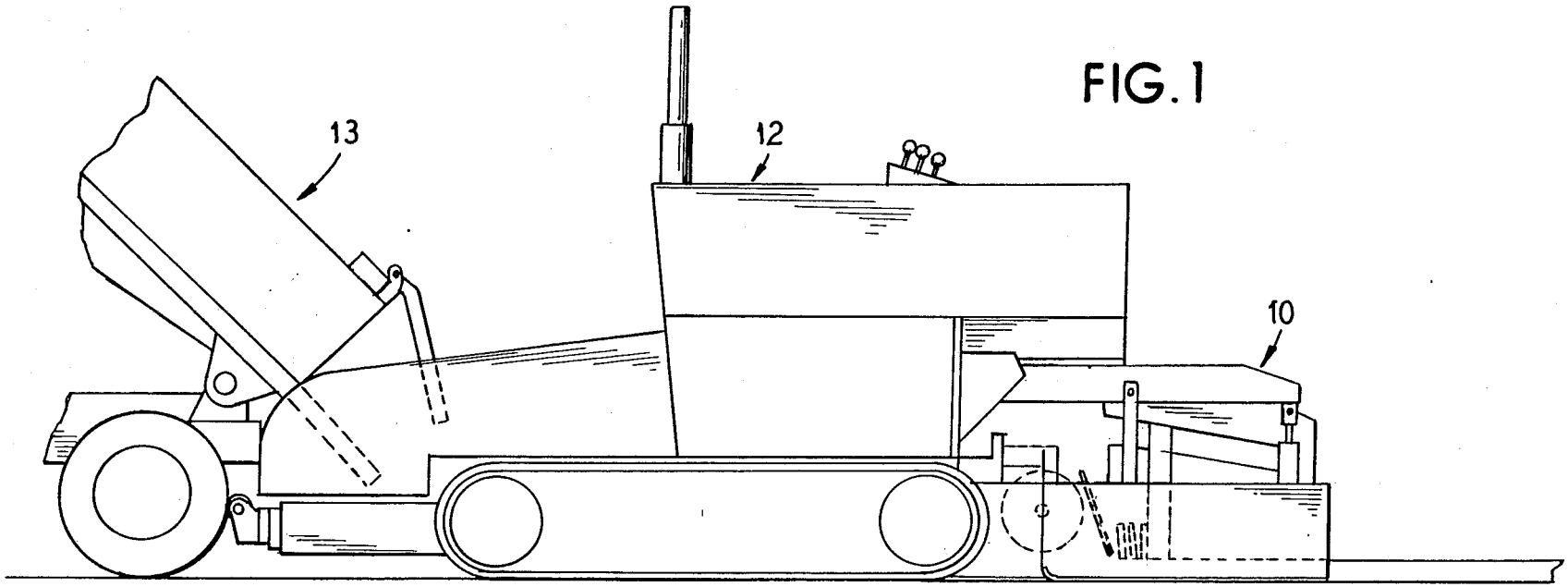
FIG. 1 is a side elevational view of a conventional roadway lay-down machine which includes the screed device of the present invention.

The principles of the present invention are incorporated in a tamping bar vibratory screed generally indicated by numeral 10 in the drawings. The screed 10 is shown in FIG. 1 in conjunction with a conventional piece of lay-down equipment 12 which is fed material to be compacted by a dumptruck 13.

As described above, existing highway finishing machines usually rely on a vibrating plate alone to provide the necessary compaction rates and finishes. While this practice is acceptable for materials which are relatively flowable, it is not suitable for less flowable, denser materials.

It is to be noted that the width of the screed 10 is adjustable to the desired width of roadway which is to be laid. This adjustability is provided by having a screed 10 which is made up of sections which are added on to provide a variety of screed widths. In the exemplary embodiment, the screed 10 is constructed of a basic screed section of 8 ft. which can be increased up to 24 ft. by adding 4, 2 and 1 foot sections. The 8 ft. section itself is made up of 2 four foot sections which are affixed with a pivot point which permits either a positive or negative crown adjustment on the roadway, depending upon the desired application. Although each four foot screed section is designed as an independent unit in the exemplary embodiment, the smaller sections may be independent units or may be dependent upon the larger four foot unit to which it is attached for power as will be described in further detail hereinafter.

Figure 2:
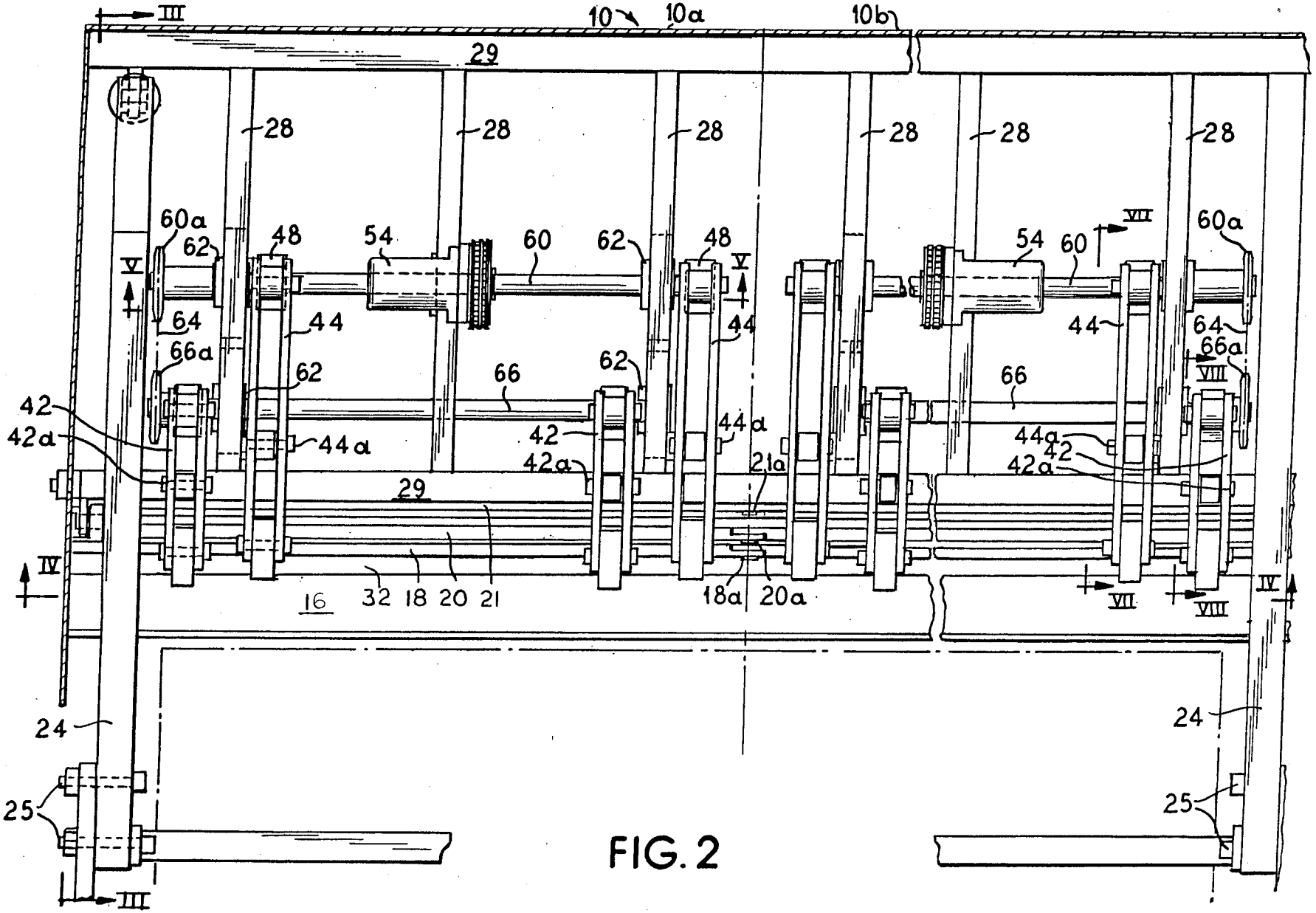
FIG. 2 is a top, fragmentary plan view of the screed device of the present invention with its top cover removed.
Figure 3:
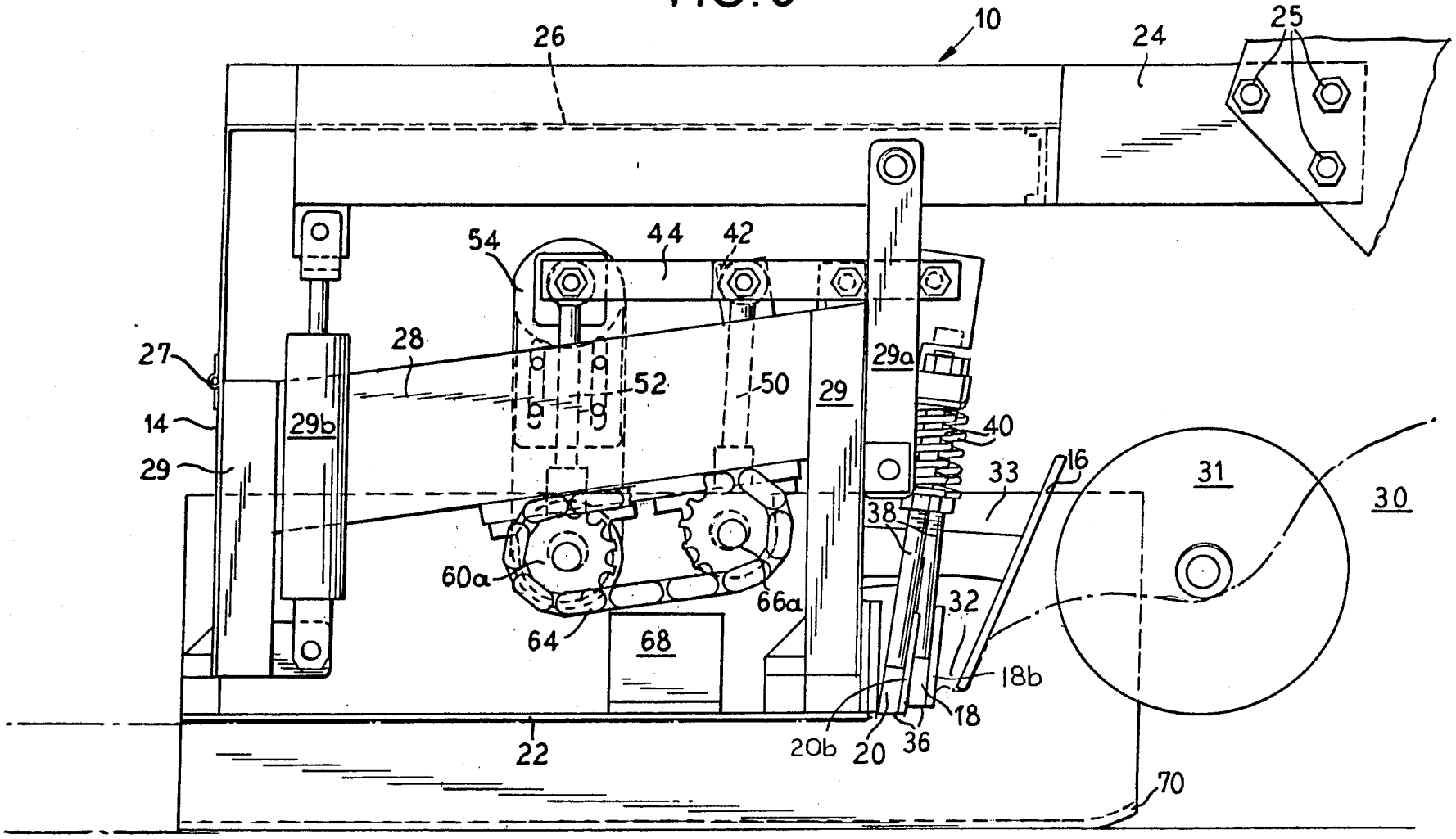
FIG. 3 is a lateral cross-sectional view taken along lines III—III of FIG. 2 with the top cover in place.

FIGS. 2 and 3 generally illustrate an eight foot screed 10 having two, four foot sections 10*a* and 10*b* which is shown fragmented. For clarity and ease of description, the screed 10 will be described as having only one section, it being understood that although some elements of the screed sections 10*a* and 10*b* are in different positions, they are basically identical and interchangeable.

The screed 10 may be powered electrically or pneumatically by its own power source or by the lay-down machine 12 and may be designed with its own means of propulsion. In the exemplary embodiment the screed 10 is provided with power and propulsion from the lay-down machine 12.

As FIG. 3 illustrates, the screed 10 is basically composed of a housing 14, a front plate 16, a front tamper bar 18, a rear tamper bar 20 and a vibrating plate 22. Normally, the screed 10 is suspended from the lay-down machine 12 by arms 24 positioned at the top of the housing 14 near its longitudinal ends, which are connected to the lay-down machine 12 with a plurality of bolts 25 in the exemplary embodiment, but can be connected in a variety of ways. These bolts 25 can be positioned in different ways and in different locations to provide a height or width adjustment between the screed 10, the roadbed and the lay-down machine 12.

As FIGS. 2 and 3 illustrate, the housing 14 is generally rectangular in shape and serves as a mounting structure for the interior parts as well as a protective shell or cover. The housing 14 is composed of a top cover having at least one door 26 and a network of transverse support members 28 which are integrally affixed to longitudinal support members 29, such as by welding, for example. Although the number of support members 28 and 29 may vary, two longitudinal support members 29 and three lateral support members 28 are employed per screed section 10*a* in the exemplary embodiment. The doors 26 is hinged to the remainder of the housing 14 on one longitudinal support member 29 by at least one hinge 27 and provides a protective cover against the elements as well as a safety cover to prevent accidental injuries or to prevent items from falling into the housing 14 and is easily openable to provide access to the interior of the screed 10. The support members 28 and 29 provide an interior frame for stability of the screed 10 as well as a frame from which the components of the present invention will be suspended as will be described in greater detail hereinafter.

As shown in FIG. 3, the arms 24 are affixed at either end of the screed 10 to the longitudinal support members 29 by supports 29*a* and 29*b* at the front and rear of the screed 10 respectively. These supports 29*a* and 29*b* are bolted to the longitudinal support members 29, and 29*b* may be in the form of an adjustable shock absorber to provide resiliency and height adjustability to the screed 10.

The screed 10 travels in a left to right direction with respect to FIG. 3 and first contacts the material to be compacted 30 with the front plate 16. The material to be compacted 30, is normally fed to the front plate 16 by an auger 31 which can be part of the screed 10 or the lay-down machine 12. The front plate 16 is affixed to the housing 14 by member 33. Member 33 may be a rigid member or may be a spring member or a type of shock absorber which will provide limited resilience to the front plate 16 which, in operation, serves to strike off the material to be compacted at a predetermined, uniform height just prior to compaction. In the exemplary embodiment, the front plate 16 is flat and slanted with a rearward angle as viewed from the front of the screed 10 which serves to slice off a vertical height of the material to be compacted. This angle also directs the excess material away from the front plate 16 and under the screed 10. Alternatively, the front plate 16 may be formed as a curved member or any other desired shape and may be affixed in a variety of ways so long as the necessary material height is achieved.

Figure 4:
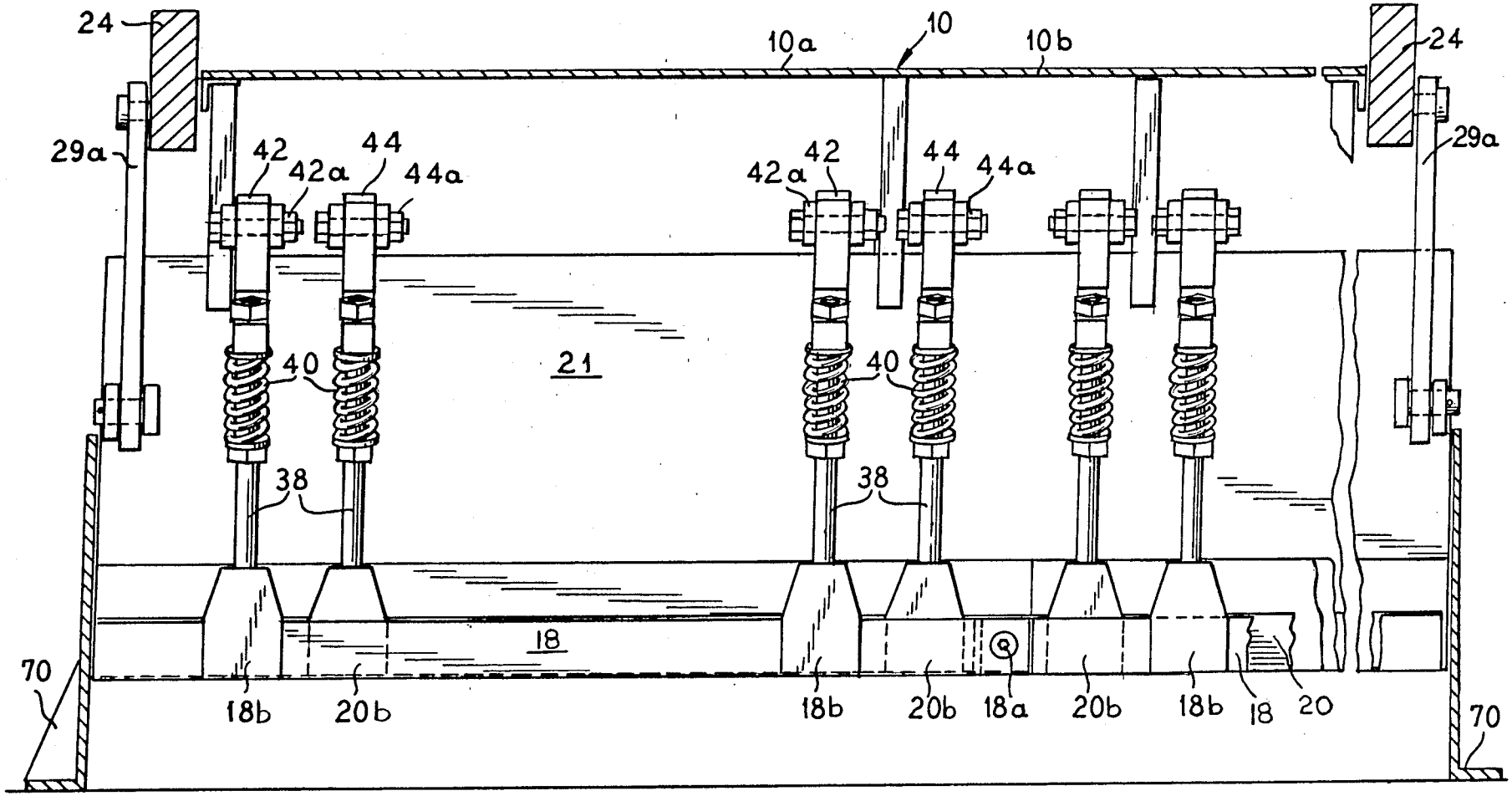
FIG. 4 is a longitudinal, fragmentary sectional view taken along lines IV—IV of FIG. 2 with the top cover in place.
Figure 7:
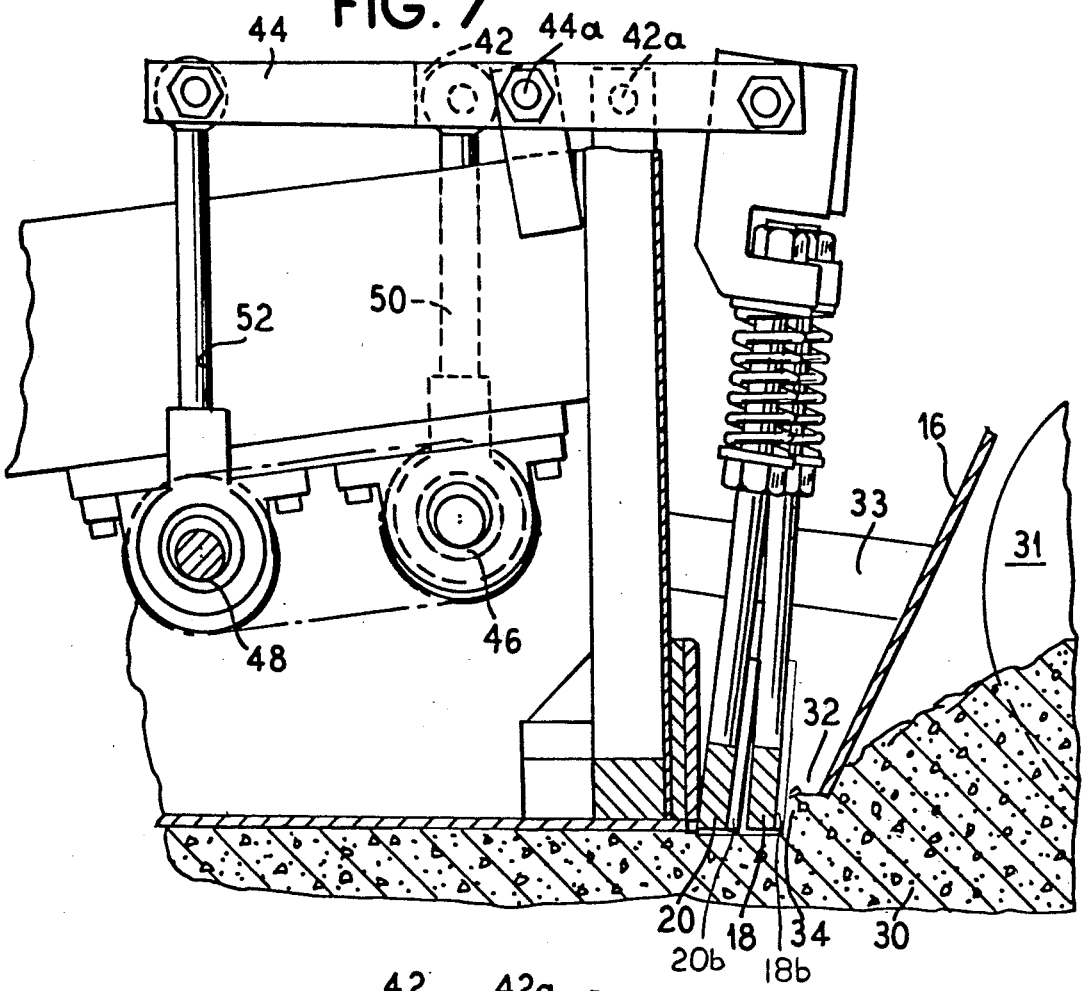
FIG. 7 is a fragmentary lateral view taken along lines VII—VII of FIG. 2.
Figure 8:
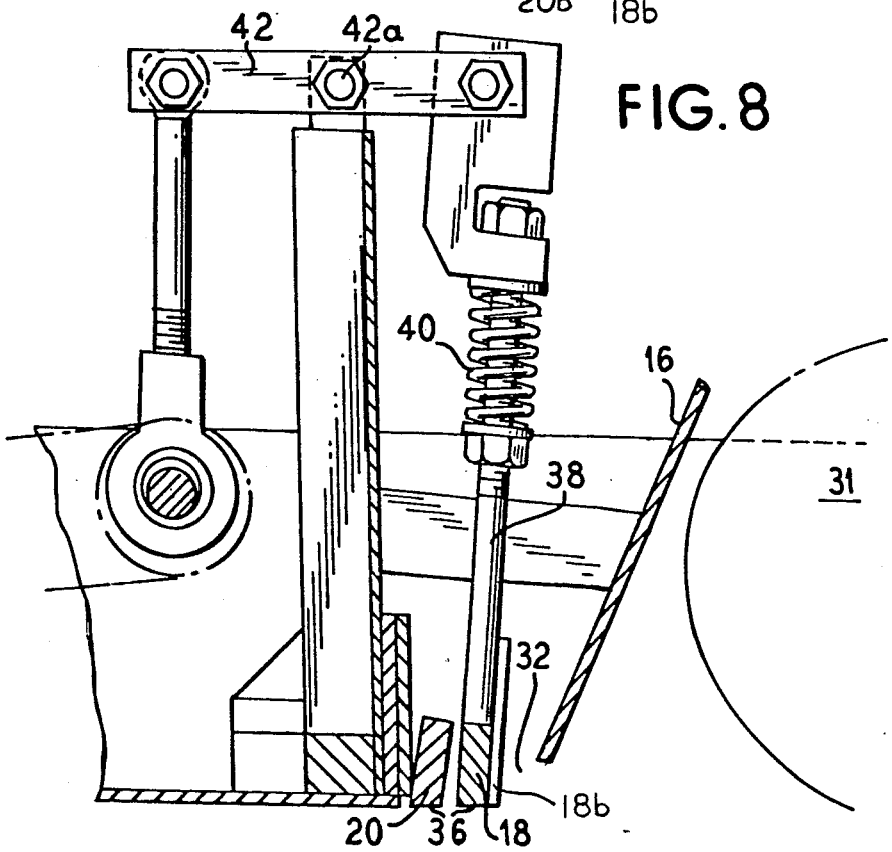
FIG. 8 is a fragmentary lateral view taken along lines VIII—VIII of FIG. 2.

Directly behind and spaced a predetermined distance from the front plate 16 are the front and rear tamper bars 18 and 20. As FIG. 4 shows, both of the tamper bars 18 and 20 span the entire width of the screed 10 and have a relatively short height in comparison to their width. These tamper bars 18 and 20 are of approximately equal length, are positioned one behind the other, are slighlly spaced apart and do not contact each other in operation. As FIGS. 3, 7 and 8 illustrate, a slight gap 32 is established between the rear of front plate 16 and the front tamper bar 18 having a width of approximately ½" (12.8 mm) in the exemplary embodiment. The gap 32 accommodates any excess material 34 (shown in FIG. 7) which may be struck off by the front tamper bar 18, after the initial striking off by front plate 16 before the tamper bar 18. With this design, by allowing for accummulation of excess material 34 in the gap 32, a smooth, even finish is provided by not forcing excess material under the tampers 18 and 20.

In the exemplary embodiment, the front tamper bar 18 extends approximately 1 inch (25.6 mm) below the bottom edge of the front plate 16 when the front tamper bar 18 is at the top of its stroke. Similarly, rear tamper bar 20, at the top of its stroke, extends approximately ¼ of an inch (6.4 mm) below the front tamper bar 18 and the vibration plate 22 extends approximately ⅛ to ¼ of an inch (3.2 mm to 6.4 mm) below the rear tamper bar 20. With this design, a gradual breakdown and compaction of the material 30 is achieved which accounts for the superiority in speed and performance of the screed 10 of the present invention. Additionally, the vertical stroke of each tamper bar 18 and 20 ranges between 1½"–2" (38.5 mm–51.3 mm) in the exemplary embodiment and can be adjusted longer or shorter to suit existing conditions as will be explained in further detail hereinafter. It is to be noted that the dimensions stated above may vary without departing from the teachings of the present invention.

Each of the tampers 18 and 20 has a flat, horizontal contact surface 36, and is powered by at least two drive assemblies made up of a shaft 38 and a spring connection 40 which in turn are connected to a pivot arm 42 for the tamper 18 and a pivot arm 44 for the tamper 20. Each tamper 18 and 20 can include supports pads **18*b* and 20*b* to secure the tampers 18 and 20 to their respective shafts 38. FIG. 8 illustrates a drive assembly of tamper bar 18 which is isolated for clarity. FIG. 4 shows that each of the tamper bars 18 and 20 has two drive assemblies along its length which are found to be adequate for driving the tamper bars 18 and 20 in the exemplary embodiment. Alternatively, the number of drive assemblies per tamper bar 18 and 20** may vary.

As FIG. 3 illustrates, the flat contact surfaces 36 are arranged at a slight angle with respect to the longitudinal axis of the tamper shafts 38 which in turn are affixed with a slight rearward angle with respect to the vertical plane. The angle of the contact surfaces 36 has the effect of providing a flat, horizontal surface while the slight rearward angle of the shafts 38 enables the material 30 to be pushed toward the rear of the screed 10 during tamping. The combination of these two design features enables the screed 10 to run at much higher speeds while providing a smooth, horizontal surface without any tearing and having the necessary compaction rates required, even for highly dense materials.

Additionally, as shown in FIG. 7 each of the tamper bars 18 and 20 is independently driven by eccentric cam drive members 46 and 48 which are coupled to the respective pivot arms 42 and 44 by drive shafts 50 and 52 respectively. In the context of the present application, independently driven refers to the fact that each of the tamper bars 18 and 20 is driven by separate eccentrics 46 and 48 respectively which are rotated by separate shafts to provide the desired motion. The rotation of each shaft and eccentric may be independent or in tandem.

Figure 6:
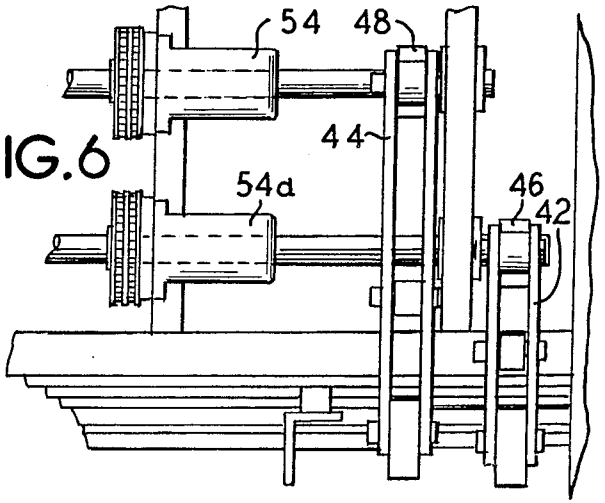
FIG. 6 is a fragmentary top plan view of the screed device, similar to FIG. 2.
Figure 5:
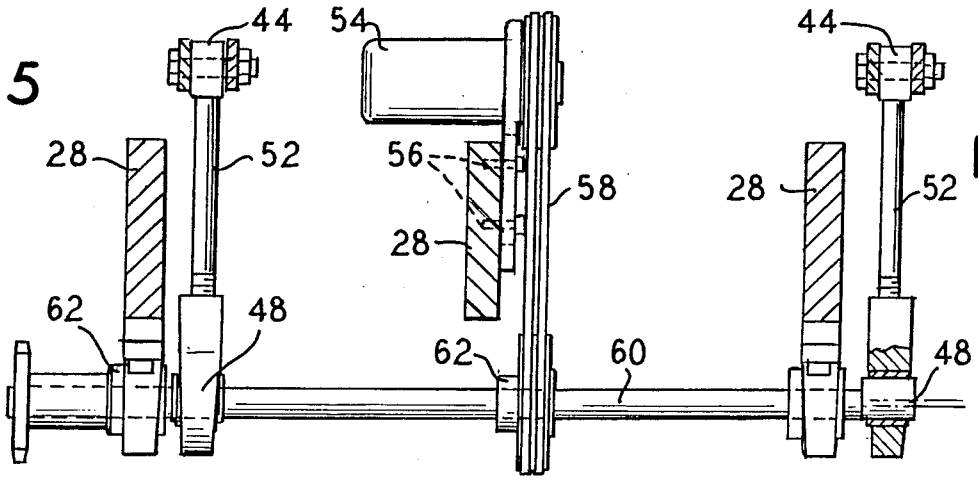
FIG. 5 is a fragmentary longitudinal view taken along lines V—V of FIG. 2.

Due to the independent eccentric drive members 46 and 48, the tamper bars 18 and 20 can be arranged to operate at the same speeds, different speeds, different strokes or at different intervals to provide a wide variety of compacting. In the exemplary embodiment, these eccentric drive members 46 and 48 are driven by the same motor 54 but can have separate motors as shown in FIG. 6 as 54 and **54*a*, if desired. In either case, the versatility in speed and stroke as well as the independence of each of the tamper bars 18 and 20** is maintained.

FIGS. 2, 3, 5, 7 and 8 illustrate the drive system of the exemplary embodiment of the present invention. It is to be understood that a variety of drive systems may be employed so long as the independence of the tamper bars 18 and 20 is maintained without departing from the teachings of the present invention.

In the exemplary embodiment as illustrated in FIGS. 2 and 3, the motor 54 is affixed to one of the lateral supports 28, such as, for example, by bolts 56. The output of the motor 54 is in turn connected to a chain belt 58 which directly drives a shaft 60. The shaft 60 is in turn connected at either end to eccentric drive members 48 and is suspended from lateral supports 28 by collars 62. With this arrangement, the eccentric motion of rear tamper bar 20 is provided. More specifically, the motor 54 rotates shaft 60 which turns eccentric drive members 48 thereby providing a vertical stroke to the shaft 52 of the pivot arm 44 which pivots about a pivot point **44*a* and provides the desired movement of the rear tamper bar 20**.

At the same time as illustrated in FIGS. 2 and 3, one end of the shaft 60 is connected to a timing chain 64 by a sprocket **60*a* which drives a shaft 66 through a sprocket 66*a*. This type of drive system exists on both ends of the screed 10, one drive for screed section 10*a* and one drive for screed section 10*b*. As FIG. 2 shows, the shaft 66 is similarly suspended from lateral supports 28 by collars 62 and is connected to eccentric drive members 46 which provide a vertical stroke to the shaft 50 of the pivot arm 42 which in turn pivots about a pivot point 42*a* and provides the desired movement of the front tamper bar 18**.

According to this exemplary embodiment, one motor 54 powers a single four foot screed section and drives two shafts 60 and 66 which in turn provide the desired stroke to both front and rear tamper bars 18 and 20 associated with the four foot screed section. As mentioned previously, it is to be understood that each shaft 60 and 66 may be driven by its own motor or by any other driving means without departing from the teachings of the present invention, so long as the tamper bars 18 and 20 are separately driven to provide the desired versatility.

The stroke and timing of each of the tamper bars 18 and 20 may be adjusted in several ways. To initially change the timing, the timing chain 64 may be adjusted or replaced. Alternatively, the eccentric drive members 46 and 48 may be changed to achieve different strokes, speeds and stroke lengths. Finally, the tension in springs 40 may be adjusted to vary the compaction or force of the stroke of each of the tamper bars 18 and 20.

It is also to be noted that due to the springs 40, over-compaction as well as under-compaction of the material 30 is eliminated. More specifically, adjustments are frequently made to the screed 10 while it is laying a particular roadway. These adjustments are necessary due to the variations which may occur in the material 30 from the particular truck load which is being fed into the screed 10 as well as other factors. These variations include the particular mix of concrete and aggregate, the particular size of aggregate, the inclusion in the aggregate of a larger piece of material as well as the outside temperature and weather conditions and the surface upon which the material 30 is being laid. Accordingly, since these springs 40 can be easily adjusted at the job site with a minimum amount of effort, the tamper bars 18 and 20 may be fine tuned to a particular job. Also, due to the resiliency provided by the springs 40 to the tamper arms 18 and 20, a large piece of aggregate within the material 30 may be traversed without damaging the screed 10 or providing an uneven finished surface.

The screed sections **10*a* and 10*b*, as well as any additional screed sections can be affixed to one another in a variety of ways. In the exemplary embodiment, the sections 10*a* and 10*b* are basically bolted together (not shown), and, as illustrated in FIGS. 2 and 4**, tamper bars 18 and 20 of adjacent sections are joined by a bolt 18*a* or 20*a* respectively and maintain even tamping along their lengths. The bolting of sections 10*a* and 10*b* is normally accomplished with a center pivot using a turnbuckle arrangement in a conventional manner.

Immediately following the rear tamper bar 20 is a wall 21 and a vibrating plate 22. The vibrating plate 22 vibrates in a vertical direction as it travels along over the material which has been pre-compacted by the tamper bars 18 and 20 to provide a smooth even finish. The vibrating plate 22 is driven by a separate motor 68. The wall 21 is a thin sheet of metal or other material which shields the interior of the screed 10 from any outside materials and may be connected to adjoining sections of walls 21 by a bolt 21*a*, for example.

To keep the compacted material from expanding horizontally and to provide a discrete outside edge, edging shoes 70 are employed along the sides of the screed 10 as FIGS. 3 and 4 illustrate. These edging shoes 70 extend parallel to the direction of travel of the screed 10, make up the exterior side walls of the housing 14 and can be vertically adjusted to provide different material thicknesses. As a consequence, no outside forms are needed.

The operation of the screed 10 will now be explained in greater detail. Material to be compacted normally arrives at the application site in a dumptruck 13 which feeds the front end of the conventional lay-down machine 12. The lay-down machine 12 is basically composed of an auger 31 which distributes the material across the desired width. In some instances, the lay-down machine 12 may be equipped for providing an initial rough compaction of the material such as with a vibrating plate. Alternatively, the material may proceed directly from the auger into the screed 10. In either event, the material exits the rear of the lay-down machine 12 where the screed 10 is then driven or pulled across. At this point, the strike-off plate 16 strikes off the material to a uniform height in preparation for compaction. After passing under the front plate 16, the material is then compacted in succession by front tamper bar 18 and rear tamper bar 20 which provide an initial compaction. Next, the vibrating plate 22 passes over the material to provide a smooth surface which may be compacted even further by a roller (not shown) if desired. During this entire sequence, the edging shoes 70 maintain the necessary discrete edge to the roadway.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An apparatus for spreading, compacting and finishing material comprising:

a support member;

strike-off means for striking off a predetermined vertical portion of said material secured to a front end of said support member;

tamping means for tamping and compacting said material with at least two separate tamping bars having a predetermined width that are arranged side by side, one behind the other, substantially parallel to one another and are driven by separate drive shafts, each of said tamping bars being slightly angled toward the rear of said apparatus away from said strike-off means and having an engagement surface along its width that is generally parallel to the horizontal plane, said tamping means being secured to said support member behind said strike-off means;

vibrating plate means having a generally vertical stroke for compacting and finishing said material secured to said support member behind said tamping means; and means for advancing and propelling said apparatus along a surface.

2. The apparatus of claim 1, where said tamping bars are positioned a predetermined distance from said strike-off means to provide a material flow area between said tamping bars and said strike-off means.

3. The apparatus of claim 1, having auger means preceding said strike-off means for distributing said material over the width of said apparatus.

4. The apparatus of claim 1, wherein said tamper bars extend substantially over the width of said apparatus generally perpendicular to the direction of travel of said apparatus and are independently driven.

5. The apparatus of claim 1, wherein said separate drive shafts are driven by separate motor means.

6. The apparatus of claim 1, wherein said separate drive shafts are driven by the same motor means.

7. The apparatus of claim 6, wherein said motor means directly drives one of said separate drive shafts which in turn drives the other of said drive shafts with a timing chain.

8. The apparatus of claim 1, wherein said tamping bars have a resilient mounting means for resiliently mounting said tamper bars to said separate drive shafts.

9. A high density vibratory screed apparatus for spreading, compacting and finishing high density materials comprising:

a main body portion;

a front strike-off plate secured to a front end of said main body portion, said strike-off plate being capable of striking off a predetermined vertical portion of said high density material;

at least two parallel tamping bars, having a predetermined width arranged side by side, one behind the other, substantially parallel to one another, said tamping bars being eccentrically driven by separate eccentric drive shafts for tamping the predetermined portion of said high density material so that said tamping bars can be arranged to operate at the same speeds, different speeds, different strokes, or at different intervals to provide a wide variety of compacting, said tamping bars being resiliently secured to said main body portion and being positioned between said main body portion and said strike-off plate, each of said tamping bars being slightly angled toward the rear of said main body portion away from said strike-off plate and having a material engagement surface along its width generally parallel to the horizontal plane;

a vibrating plate secured to the bottom of said main body portion immediately behind said tamping bars, said vibrating plate being driven in a vertical direction by its own separate motor means; and means for advancing and propelling said apparatus.

10. The apparatus of claim 9, wherein said separate eccentric shafts are driven by at least one motor means for driving said shafts, said at least one motor means being directly affixed to one of said separate shafts which in turn drives the other of said shafts with a timing chain.

11. The apparatus of claim 9, wherein said front strike-off plate, said tamping bars, and said vibrating plate extend substantially over the width of the apparatus, generally perpendicular to the direction of travel of the apparatus.

12. A device for compacting materials comprising:

at least two elongated tamping bars having a predetermined width, said tamping bars being arranged side by side, one behind the other, substantially parallel to one another and extending generally perpendicular to the direction of travel of said device, substantially over the width of said device, and positioned with a slightly rearward angle with respect to the direction of travel of said device for compacting the desired material along their widths; and means for independently driving each of said at least two tamping bars.

* * * * *